US005370291A

United States Patent [19]

Kusmierz et al.

[11] Patent Number: 5,370,291

[45] Date of Patent: Dec. 6, 1994

[54] SYSTEM FOR TRANSPORTING WEB-SHAPED RECORDING SUBSTRATES IN PRINTING DEVICES

[75] Inventors: Hans Kusmierz, Gilching; Hans Taubenberger, Gmund, both of Germany

[73] Assignee: Mannesmann Aktiengesellschaft, Dusseldorf, Germany

[21] Appl. No.: 945,849

[22] Filed: Sep. 16, 1992

[30] Foreign Application Priority Data

Mar. 16, 1990 [EP] European Pat. Off. ..... 90105029.4

[51] Int. Cl.[5] ..... B41J 11/50

[52] U.S. Cl. ..... 226/110; 192/18 R; 226/108; 400/605

[58] Field of Search ..... 226/108, 110, 102, 101; 400/605, 616, 616.2; 192/12 R, 18 R, 12 B

[56] References Cited

U.S. PATENT DOCUMENTS

| | | | |
|---|---|---|---|
| 4,360,279 | 11/1982 | Sugiura | 400/605 X |
| 4,418,808 | 12/1983 | Nagai | 192/18 R |
| 4,606,663 | 8/1986 | Christoph et al. | 400/605 |
| 4,688,957 | 8/1987 | Prevignano | 400/605 |
| 4,759,649 | 7/1988 | Kelly et al. | 400/616.3 |
| 4,909,497 | 3/1990 | Itabashi et al. | 400/605 X |
| 5,087,142 | 2/1992 | Suzuki et al. | 400/616 |
| 5,094,327 | 3/1992 | Fischer et al. | 192/18 R |

FOREIGN PATENT DOCUMENTS

| | | |
|---|---|---|
| 0123310 | 10/1984 | European Pat. Off. . |
| 0243601 | 11/1987 | European Pat. Off. . |
| 2461015 | 11/1979 | Germany . |

OTHER PUBLICATIONS

Publication: IBM Technical Disclosure Bulletin, vol. 27, No. 4B, Sep. 1984, IBM Corp., M. E. Momot et al: "Bidirectioinal forms-tensioning feeding system", pp. 2511-2512.

*Primary Examiner*—Daniel P. Stodola
*Assistant Examiner*—William Stryjewski
*Attorney, Agent, or Firm*—Horst M. Kasper

[57] ABSTRACT

The transport device (10, 10*a*) for web-shaped recording substrates (3, 3*a*, 3*b*) includes transport devices (13, 13*a*, 15, 15*a*, 15*b*) driven by an electromotor, wherein the transport devices (13, 13*a*, 15, 15*a*, 15*b*) transport back and forth and asynchronously the recording substrate (3, 3*a*, 3*b*) from a starting position (IP, IP1, SP, SP1) to a target position (PP, PP1, TP, TP1). A gear coupling (16, 16*a*, 16*b*) is in addition coordinated to the transport devices (13, 13*a*, 15, 15*a*, 15*b*), wherein the gear coupling (16, 16*a*, 16*b*) controls automatically the tension of the recording substrate (3, 3*a*, 3*b*) tensioned between the transport devices (13, 13*a*, 15, 15*a*, 15*b*). In addition, the transport device (15, 15*a*, 15*b*) can be disengaged from the electromotor drive (11, 11*a*) by actuating an operating lever (19, 19*a*), wherein the operating lever (19, 19*a*) engages the gear coupling (16, 16*a*, 16*b*), when sheet-shaped recording substrates (2, 2*a*, 2*b*) are to be transported in addition to the web-shaped recording substrates (3, 3*a*, 3*b*) in the printing device (1, 1*a*).

18 Claims, 5 Drawing Sheets

SYSTEM FOR TRANSPORTING WEB-SHAPED RECORDING SUBSTRATES IN PRINTING DEVICES

CROSS-REFERENCE TO RELATED APPLICATIONS

This application is a continuation-in-part application of another international application filed under the Patent Cooperation Treaty Mar. 1, 1991, bearing Application No. PCT/DE91/00197, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to a device for transporting web-shaped recording substrates in printing devices including a first and a second transport device, wherein the transport devices are in each case driven by a gear at different speeds, and wherein one of the transport devices is in addition driven by a coupling.

2. Brief Description of the Background of the Invention Including Prior Art

Modern printing devices, for example ink jet printers, are characterized by a marked user-friendly operating procedure during the printing of web-shaped recording substrates. The operational friendliness of a printing device is of particular importance for the user, where the printing device is to print on sheet-shaped recording substrates in addition to web-shaped recording substrates. In order to fulfill this requirement, however, more complicated, mechanical transport devices are necessary with which the sheet-shaped or, respectively, web-shaped recording substrates are fed to a printing station. In the following, the term continuous form paper or, respectively, individual sheet is employed for the term web-shaped or, respectively, sheet-shaped recording substrate. A recording substrate is intended in this case to include recording substrates which can differ both in their kind, for example, paper, cardboard, foil, as well as in the grade of pretreatment, for example, edge perforation, preprinted forth.

If for example a user wishes to print a single sheet after the printing of alphanumerical characters onto the continuous form paper, then the unprinted part of the continuous form paper, still disposed in a roller wedge of the transport device, has to be moved into a stand-by position for the next printing procedure. The continuous form paper, disposed in the stand-by position, has to be fed again to the printing station following the printing of the individual sheet.

A further requirement associated with such a transport device is brought about in that a printing procedure, interrupted for a certain time period (printing pause), results in that the continuous paper is moved to a so-called tear-off position. If the printing procedure of the continuous form paper is now to continue from the preceding printing procedure, then the continuous form paper has to be transported anew from the tear-off position back into the printing position.

A paper transport device for individual sheets and continuous form paper in printing devices is known from the European Patent document EP-A2-0,123,310. The paper transport device exhibits for this purpose a switching gear, which mechanically couples a drive motor to a printer platen or, respectively, the drive motor to a paper tractor and the printer platen dependent on the operation type, single sheet or continuous form paper, of the printing device. The switching gear is in this case formed such that no malfunctions, such as for example paper jamming, occur during the transition from the operation type continuous form paper to the operation type single sheet or vice versa. The back transport of the individual sheets or, respectively, of the continuous form paper is achieved by the rotation direction reversal of the drive motor. It is a disadvantage of the known paper transport device that the mechanical coupling between the paper tractor and the printer platen has to be very accurate in order to be able to transport the edge-perforated continuous form paper without any problems, perfectly, and accurately in its position.

Furthermore, a paper feed device for printing devices is known from the U.S. Pat. No. 4,688,957, wherewith individual sheets or continuous form paper can selectively be fed over a friction roller to a printing station. A paper tractor, separating rollers, and the friction roller are in this case driven over a gear by an electromotor. A gear coupling is provided in the gear for the selection of the operation type single sheet or continuous paper, where the gear coupling can be manually operated with an operating lever. Since the paper tractor for both transport directions of the continuous form paper is at all times coupled to the friction roller in case of the known feed device during the continuous form paper operation, the same disadvantages occur as with the technical teachings of the European Patent document EP-A2-0,123,310.

In addition it is possible to transport continuous form paper, for example edge-perforated fanfold paper, only backwards, jointly over a tractor and a printer platen. In this case, both the paper tractor as well as the printer platen are driven by a step motor, which is in each case connected over a gear with the tractor and the printer platen. A freewheel is disposed in the gear between the paper tractor and the step motor, where the freewheel blocks in reverse direction. In forward direction, the edge-perforated fanfold paper is manually shifted by rotation of a handwheel from an insertion or, respectively, stand-by position in a roller wedge of the printer platen. In this case, the handwheel of the paper tractor is to be rotated in a direction opposite to the handwheel of the printer platen. When the edge-perforated fanfold paper reaches the roller wedge, then the friction drive of the printer platen takes over the further transport. The advance rate of the edge-perforated fanfold paper is exclusively determined by the friction drive of the printer platen. The friction drive is thereby disengaged from the paper tractor in forward direction by the effective freewheel. This is achieved in that the freewheel is driven faster by the step motor than the edge-perforated fanfold paper is carried along by the friction drive. During the pulling in of the edge-perforated fanfold paper, the paper tractor is pulled along by the edge-perforated fanfold paper.

This principle of pulling in and back transportation of edge-perforated fanfold paper has the disadvantage that the edge-perforated fanfold paper, disposed in the stand-by position, can only be moved slightly, i.e. a maximum of 1/6 inch, backward through the printer platen. If the edge-perforated fanfold paper is moved backwards by a larger distance, then the paper tractor pushes the edge-perforated fanfold paper backwardly out of the printer device as a result of the blocked freewheel. This occurs for example during the change from the continuous form paper operation to the single sheet operation in a printing device. Such a backward motion occurs however for example during the printing of several exponents onto a single sheet.

SUMMARY OF THE INVENTION

Purposes of the Invention

It is the object of the present invention to construct a device for the transport of web-shaped recording substrates in printing devices, wherein the web-shaped recording substrate, inserted in the printing device, can be automatically pulled in for the printing under lateral guidance, can be transported to a target position, and can again be transported in reverse.

It is a further object of the present invention to provide for a device for the transport of recording substrates in printing device, wherein sheet-shaped recording substrates can selectively be transported with the device in addition to web-shaped recording substrates.

These and other objects and advantages of the present invention will become evident from the description which follows.

Brief Description of the Invention

The present invention provides for a device for transporting web-shaped or individual-sheet-shaped recording substrates in a printing device. A first transport device is driven through a gear at a first speed. The first transport device, acting first in advance transport direction of a recording substrate, is formed by a pin feed drive, driven by a gear coupling. A second transport device is driven through a second gear at a second speed different from the first speed. The second transport device, acting subsequently to the first transport device in advance transport direction of the recording substrate, is formed by a friction drive, driven without coupling. The individual-sheet-shaped recording substrates are directly fed to the friction drive. A locking nose can be engaged with a crown gear. A pin feed drive can be fixed in position by the locking nose. Switching means are furnished by an operating lever and are provided with a first rest and locking position and a second rest and locking position. The switching means are disposed in the region of the gear coupling. The operating lever separates the gear coupling in the second rest and locking position and simultaneously fixes the pin feed drive by means of the locking nose engaging the crown gear.

The friction drive can drive the web-shaped recording substrate at a slightly faster speed than the pin feed drive and the friction drive can drive the web-shaped recording substrate at a slightly slower speed than the pin feed drive. The speed difference can be from about 0.1 to 20 percent and is preferably from about 1 to 5 percent.

The first transport device can include a drive shaft. A spring element can be disposed at the drive shaft. The gear coupling can include a first coupling arrangement. The first coupling arrangement can be attached on the drive shaft of the first transport device. The gear coupling can include a second coupling arrangement. The second coupling arrangement can be supported rotatable and axially shiftable against the spring element at the drive shaft of the first transport device and can thereby be coupled to the gear wheel drive. The second coupling arrangement can include a first coupling element. The first coupling arrangement can include a second coupling element. The first coupling arrangement can be connected to the second coupling arrangement through a first coupling element and through a second coupling element.

The first coupling element and the second coupling element can be formed as coupling gearings.

The switching device can disengage the second coupling arrangement from the first coupling arrangement. The switching device can be formed as an operating lever having a wedge-shaped projection. The operating lever can be tilted toward the drive shaft. The wedge-shaped projection can press against the second coupling arrangement upon tilting the operating lever toward the drive shaft. The wedge-shaped projection can shift the second coupling arrangement in an axial direction against a spring force of the spring element on the drive shaft. The wedge-shaped projection can a gear wheel of the second coupling arrangement in an axial direction against a spring force of the spring element on the drive shaft.

The locking nose can engage the crown gear of the first coupling arrangement in a state where the operating lever is swivelled toward the drive shaft.

A leaf spring can be tensioned between two points and including a bulge. The bulge of the leaf spring can fix the operating lever in a first state against a stop pin and in a second state against the crown gear.

The first transport device can include a drive shaft. The gear coupling can include a first coupling arrangement. The first coupling arrangement can be attached on the drive shaft of the first transport device. The gear coupling can include a second coupling arrangement. The second coupling arrangement can be rotatably supported at the drive shaft of the first transport device. The second coupling arrangement can thereby be coupled to a second gear wheel drive. The first coupling arrangement can include a first coupling element. The second coupling arrangement can include a second tiltably supported coupling element. The first coupling arrangement and the second coupling arrangement can be connected to each other through the first coupling element and through the second coupling element. The second coupling arrangement can include actuating means coupled to the second gear wheel drive. The actuating means can change a tilting position of the second coupling element against a spring force of a spring element depending on the rotation direction of the electromotor.

The first coupling element can be formed as two flange gearings. The two flange gearings can be axially shifted relative to each other and can run in opposite directions. The second coupling element can be formed as a rocker with two engagement tips.

The gear coupling can include a first coupling arrangement. The first coupling arrangement can be rotatably supported on a shaft and can be coupled to a gear wheel drive. The gear coupling can include a second coupling arrangement. The second coupling arrangement can be supported rotatably and axially shiftable against a second spring force of a second spring means at the shaft and can be disengaged from the first transport device. The first coupling arrangement can include a first coupling element and the second coupling arrangement can include a second coupling element. The coupling arrangements can be connected to each other through the first coupling element and through the second coupling element. The second coupling arrangement can include means for the temporary disengagement of the transport device from an electromotor. The second coupling element can be axially shifted against the second spring force of the second spring means and the shaft with the actuating means.

The coupling elements can be formed as claws.

The actuating means can include a projection disposed opposite to the coupling element. The projection can move in the forward rotation direction of the electromotor onto the insertion taper, pretensioned by a first spring means. The projection can press away the insertion taper against a first spring force of the first spring means while the projection is disposed in backward rotation direction of the electromotor.

An economic construction of the transport device is achieved with low space requirements and simple operating surface by the use of a gear coupling or, respectively, jaw clutch coupling or of a ratchet mechanism for the automatic control of the tension of a web-shaped recording substrate, tensioned between the transport means, for example edge-perforated fanfold paper or continuous form paper, during the fully automatic pulling in of the laterally guided recording substrate in the roller wedge and during its advance transport and reverse transport into the target position or, respectively, out of the target position. The automatic control of the tension of the recording substrate can be performed independent of the asynchronous transport of the recording substrate by the electromotor-driven transport device, for example, of a friction drive or, respectively a pin-feed tractor drive.

In addition, the pin-feed tractor drive, holding the web-shaped recording substrate in a stand-by position, can be disconnected with the aid of a mechanical, simply constructed operating lever from the electromotor-driven drive, where the operating lever is coordinated to the gear coupling or, respectively, claw clutch coupling or the ratchet mechanism. It is thereby possible to print also sheet-shaped recording substrates in addition to web-shaped recording substrates in a printing device.

It can also be prevented by the operating lever that based on possible friction connections the pin-feed tractor drive, holding the web-shaped recording substrate in the stand-by position, rotates during the individual-sheet operation.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawing, in which are shown several of the various possible embodiments of the present invention.

DESCRIPTION OF INVENTION PREFERRED EMBODIMENT

Figure 1:
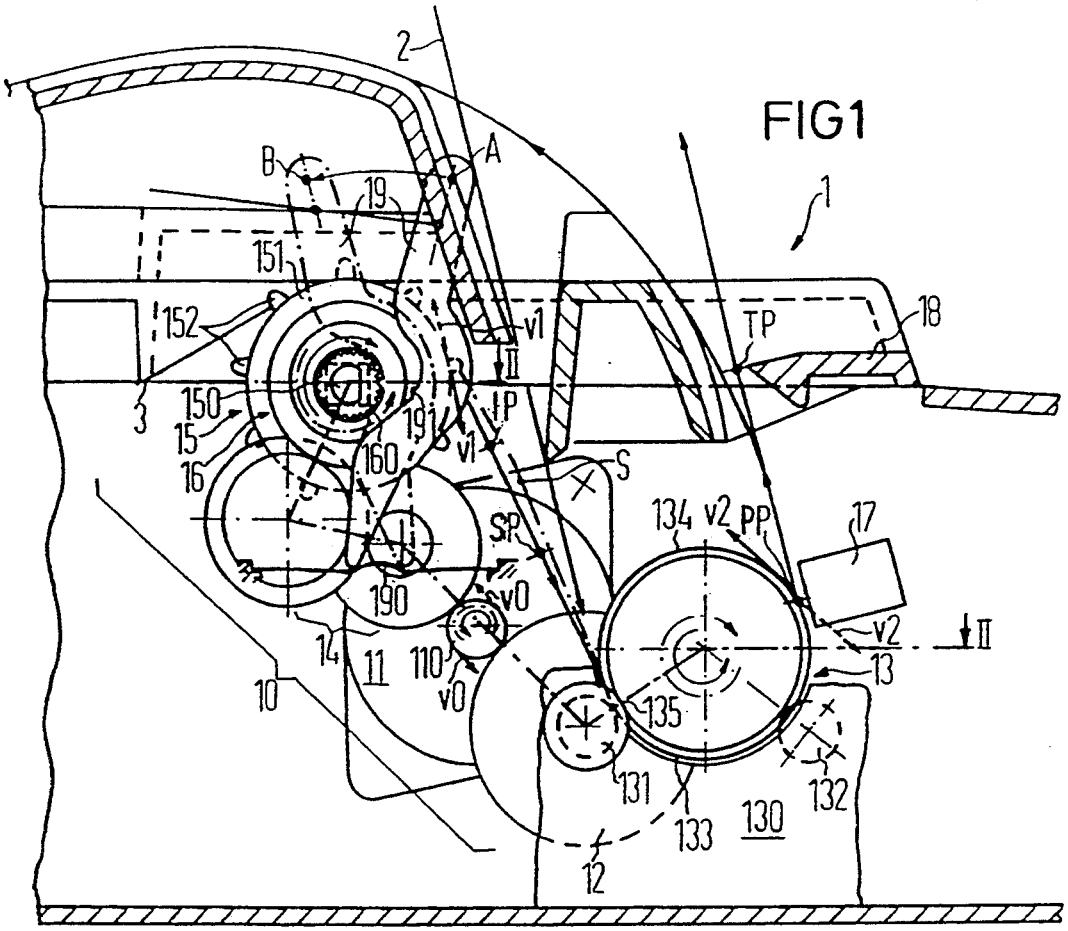
FIG. 1 is a view of a transport device for individual sheets or continuous form paper in a sectional view through an ink jet printing device, illustrating a first embodiment of a transport mechanism.

According to the present invention there is provided for a device for transporting web-shaped or individual-sheet-shaped recording substrates in a printing device. A first and a second transport device are in each case driven via a gear at different speeds. One of the transport devices is in addition driven by a coupling. The first transport device, acting first in advance transport direction of the recording substrate 3, 3*a*, 3*b*, is formed by a pin feed drive 15, 15*a*, 15*b*, driven by a gear coupling 16. The second transport device, acting subsequently to the first transport device in advance transport direction of the recording substrate 3, 3*a*, 3*b*, is formed by a friction drive 13, 13*a*, driven without coupling. The individual-sheet-shaped recording substrates 2 are directly fed to the friction drive 13, 13*a*. Switching means, furnished by an operating lever 19 and provided with two rest and locking positions A, B, are disposed in the region of the gear coupling 16. The operating lever 19 separates the gear coupling 16 in a rest position B and simultaneously fixes the pin feed drive 15, 15*a*, 15*b* by means of a locking nose 191 engaging a crown gear 160.

The friction drive 13*a* can drive the web-shaped recording substrate 3, 3*a*, 3*b* at a slightly faster or at a slightly slower speed than the pin feed drive 15, 15*b*. The speed difference can be from about 0.1% to 20% and is preferably from about 1% to 5%.

The gear coupling 16 can include a first coupling arrangement 165, 166. The first coupling arrangement can be formed by a gear disk 165 and by a coupling gearing 166. The first coupling arrangement 165, 166 can be attached on a drive shaft 150 of the first transport device 15. The gear coupling 16 can include a second coupling arrangement 161, 164. The second coupling arrangement can be formed by a gear wheel 161 and by a coupling gearing 164. The second coupling arrangement 161, 164 can be supported rotatable and axially shiftable against a spring force F at the drive shaft 150 of the first transport device 15 and can thereby be coupled to the gear wheel drive 14. The second coupling arrangement 161, 164 can include a first coupling element 164, formed by the coupling gearing 164, and the first coupling arrangement 165, 166 can include a second coupling element 166, formed by the coupling gearing 166. The coupling arrangements 161, 164; 165, 166 can be connected to each other through the first coupling element 164 and through the second coupling element 166.

The operating lever forming a switching device 19 can disengage the second coupling arrangement 161, 164 relative to the first coupling arrangement 165, 166.

The switching device forming the operating lever 19 with a wedge-shaped projection 192 can be tilted toward the drive shaft 150. The wedge-shaped projection 192 can press against the second coupling arrangement 161, 164 upon tilting the operating lever 19 toward the drive shaft 150, and shifts the second coupling arrangement 161, 164 or the gear wheel 161 in axial direction against the spring force F on the drive shaft 150.

The operating lever 19 can include the locking nose 191. The locking nose 191 can engage the crown gear 160 of the first coupling arrangement 165, 166 in a state where the operating lever 19 is swivelled toward the drive shaft 150.

A leaf spring 190 can be tensioned between two points and can include a bulge 197. The bulge 197 can fix the operating lever 19 in a first state A against a stop pin 196 and in a second state B against the crown gear 160.

Alternatively, the gear coupling **16*b*, formed by a ratchet mechanism, can exhibit a first coupling arrangement 163*b*, 164*b*, 165*b* formed by a wheel 163*b*, a flange gearing 164*b* and a flange gearing 165*b*. The first coupling arrangement 163*b*, 164*b*, 165*b* can be attached on a drive shaft 150*b* of the first transport device 15*b*. The gear coupling 16*b* can exhibit a second coupling arrangement 160*b*, 161*b*, 162*b*, 166*b* formed by a cam 160*b*, a cam wheel 161*b*, a rocker 162*b*, and a wheel 166*b*. The second coupling arrangement 160*b*, 161*b*, 162*b*, 166*b* can be rotatably supported at the drive shaft 150*b* of the first transport device 15*b* and can thereby be coupled to the gear wheel drive 14. The first coupling arrangement 163*b*, 164*b*, 165*b* can exhibit a first coupling element 164*b*, 165*b*, formed by the two flange gearings. The second coupling arrangement 160*b*, 161*b*, 162*b*, 166*b* can exhibit a second tiltably supported coupling element 162*b*, formed by the rocker 162*b*. The coupling arrangements 160*b*** through 166*b* are connected to each other through the first coupling elements **164*b*, 165*b* and through the second coupling element 162*b*. The second coupling arrangement 160*b*, 161*b*, 162*b*, 166*b* can include actuating means 160*b*, 161*b*, formed by a cam and a cam wheel, coupled to the second gear wheel drive 14. The actuating means 160*b*, 161*b* can change the tilting position of the second coupling element 162*b* against the spring force of a spring element 170*b* depending on the rotation direction of the electromotor 11**.

The two flange gearings, forming the first coupling element **164*b*, 165*b* can be axially shifted relative to each other and can be oppositely running. The rocker forming the second coupling element 162*b* can exhibit two engagement tips 168*b*, 169*b***.

Furthermore, the gear coupling **16*a* can exhibit a first coupling arrangement 144*a*, 163*a* formed by a spur wheel 144*a* and a spur wheel bushing 163*a*. The first coupling arrangement 144*a*, 163*a* can be rotatably supported on a shaft 141*a* and can be coupled to the gear wheel drive 14*a*. The gear coupling 16*a* can exhibit a second coupling arrangement 145*a*, 160*a*, 164*a*, 166*a*, 167*a*, formed by a spur wheel 145*a*, a spring 160*a*, a spur wheel bushing 164*a*, a projection 166*a*, and an insertion taper 167*a*. The second coupling arrangement 145*a*, 160*a*, 164*a*, 166*a*, 167*a* can be supported rotatable and axially shiftable against a second spring force F2 at the shaft 141*a* and can be disengaged from the first transport device 15*a*. The first coupling arrangement 144*a*, 163*a* can include a first coupling element 163*a*, formed by the spur wheel bushing, and the second coupling arrangement 145*a*, 160*a*, 164*a*, 166*a*, 167*a* can include a second coupling element 164*a*, formed by the spur wheel bushing. The coupling arrangements 144*a*, 145*a*, 160*a*, 163*a*, 164*a*, 166*a*, 167*a* can be connected to each other through the first coupling element 163*a* and through the second coupling element 164*a*. The second coupling arrangement 145*a*, 160*a*, 164*a*, 166*a*, 167*a* can exhibit actuating means 160*a*, 166*a*, 167*a* for the temporary disengagement of the transport device 13*a* from the electromotor 11*a*. Said actuating means can be formed by the spring 160*a*, the projection 166*a*, and the insertion taper 167*a*. The second coupling element 164*a* is axially shifted against the second spring force F2 and the shaft 141*a* with the actuating means 160*a*, 166*a*, 167*a***.

The coupling elements **163*a*, 164*a*** can be formed as claws.

The projection **166*a* of the actuating means 160*a*, 166*a*, 167*a* can be disposed opposite to the coupling element 164*a*. The projection 166*a* can move in the forward rotation direction of the electromotor 11*a* onto the insertion taper 167*a*, pretensioned by the spring 160*a*. The projection 166*a* can press away the insertion taper 167*a* against a first spring force F1 of the spring 160*a* while the projection 166*a* is disposed in backward rotation direction of the electromotor 11*a***.

FIG. 1 illustrates the construction of a transport device 10 for the selective transport of individual sheets 2 and edge-perforated continuous form paper 3, for example, edge-perforated fanfold paper in a sectional view through an ink jet printing device 1. An electromotor 11 with a drive pinion 110 is characteristic for the transport device 10, wherein the drive pinion 110 is coupled with a first gear wheel drive 12 to a second transport device, as seen in advance transport direction of the recording substrate, for example a friction drive 13, as well as with a second gear wheel drive 14 and a gear coupling 16 to a first transport drive 15, as seen in advance transport direction of the recording substrate, for example a pin feed platen or a pin-feed tractor drive, for the continuous form paper 3. Alternatively, it would also be possible to form the second transport device 13 as a pin-feed tractor drive or a pin feed platen and the first transport device as a friction drive.

The friction drive 13 includes a paper deflection 130, wherein two paper guide rollers 131, 132 are disposed in the paper deflection area 130. The paper guide rollers 131, 132 are disposed such that a rotatably supported printer platen 134, forming a guide channel 133 together with the paper deflection 130, forms a roller pairing together with the paper guide rollers 131, 132. Based on the roller pairing between the printer platen 134 and the paper guide roller 131 there is formed a roller wedge 135, where the individual sheet 2 and the continuous form paper 3 have to reach the roller wedge 135 in order to be transported by the friction drive 13 for the preset rotation direction of the drive pinion 110 (solid arrow) in a print position PP in front of a print station 17 of the ink jet print device.

While the individual sheet 2 can be inserted directly into the roller wedge 135, for example manually, the edge-perforated continuous form paper 3 is transported for the illustrated rotation of the drive pinion 110 (solid arrow) through the first transport device 15 into the roller wedge 135. For this purpose, the transport device 15 exhibits two pin-feed tractor wheels 151, disposed on a drive shaft 150. The pin-feed tractor wheels 151 exhibit in each case radially projecting pins 152. The pins 152 engage in an edge perforation on the left-hand side and on the right-hand side of the continuous form paper 3. Alternatively, it is however also possible to dispose only one pin-feed tractor wheel 151 on the drive roller 150. In order to transfer the torque, emitted by the electromotor 11, to the drive shaft 150 and to the pin-feed tractor wheels 151, the gear coupling 16 is furthermore disposed on the drive shaft 150. The gear coupling 16 is coupled to the gear wheel drive 14. The method of operation and the construction of the gear coupling 16 are described based on the FIGS. 2 through 10.

If the edge-perforated continuous form paper 3 to be printed has reached an insertion position IP over the pin-feed tractor wheel 151, then the edge-perforated continuous form paper 3 is initially moved with a peripheral speed v1 of the pin-feed tractor wheels 151 up into the roller wedge 135 for the illustrated rotation direction of the drive pinion 110 (solid arrow). Subsequently, the continuous form paper 3 is taken over by the friction drive 13 and is passed with a peripheral speed v2 of the printer platen 134 in front of the print station 17 and further in front of a tear-off edge 18 of the ink jet printing device 1. In this way, the edge-perforated continuous form paper 3 can be brought line-by-line into the print position PP, can be printed there line-by-line, and can be further transported into a tear-off position TP. The transfer ratios of the gear drives 12, 14 are in this case selected such that, starting from a peripheral speed v0 of the electromotor 11, the peripheral speed v2 is slightly larger than the peripheral speed v1. In order to avoid, for example, a tearing of the edge-perforated continuous form paper 3 in the region of the edge perforation in case of this translation ratio, the pin-feed tractor wheel 151 is disengaged from the drive pinion 110 of the electromotor 11 with the gear coupling 16. The disengagement results in that the pin-feed tractor wheel 151 is pulled along faster by the edge-perforated continuous form paper 3, transported by the friction drive 13, than the pin-feed tractor wheel 151 is driven by the electromotor 11 with the gear wheel drive 14.

If according to a first assumption in case of an operation with continuous form paper, the printing process is now to be continued after a printing pause at the tear-off position TP of the edge-perforated continuous form paper 3, then the edge-perforated continuous form paper 3 has to be transported back into the print position PP. In this case, the printer platen 134 and the pin-feed tractor wheels 151 are driven by the electromotor 11 in opposite direction (dashed arrow). The edge-perforated continuous form paper 3 is jammed between the friction drive 13 and the transport device 15 based on the speed ratios preset by the translation of the gear wheel drives 12, 14. This is indicated in FIG. 1 by a loop S. In order to assure a problem-free back transport of the continuous forth paper 3, the loop formation S is limited to such an extent during the reverse transport, based on the transmission ratio from the electromotor 11 to the friction drive 13 and from the electromotor 11 to the feed device 15, 16, 19, that the pins 152 of the pin-feed tractor wheels 151 still further engage the edge perforation of the continuous form paper 3 and guide the continuous forth paper 3 on its sides. The feed device can be formed by the pin-feed drive 15, the gear coupling 16, and the operating lever 19.

In the case where after the printing of the edge-perforated continuous form paper 3 at least one individual sheet 2 has to be printed, then the unprinted part of the edge-perforated continuous form paper 3, still disposed in the guide channel 133 of the friction drive 13, has to be moved and transported into a so-called ready or stand-by position SP for the next printing process. The stand-by position SP is thereby disposed to such an extent in front of the roller wedge 135 that the individual sheets 2 can be inserted conveniently into the roller wedge 135 by hand. The loop S is formed again during this back transport based on the speed ratios between the printer platen 134 and the pin-feed tractor wheels 151. The loop S is again only so large, based on the recited measures, that the pins 152 of pin-feed tractor-wheels 151 continue also to engage still further into the edge perforation of the continuous form paper 3.

The rotation direction of the electromotor 11 is again reversed (solidly drawn arrow) before the individual sheets 2 are now inserted into the roller wedge 135. However, it has to be prevented in this context that also the pin-feed tractor wheels 151 and thereby the edge-perforated continuous form paper 3 are moved forward again from the stand-by position SP. The transport device 10 exhibits for this purpose a lever 19 which can be, for example, manually operated. The lever 19 is swivelled from a state A for the continuous form paper operation into a state B for the individual sheet operation. In this case, the lever 19 is in addition further pressed with a leaf spring 190, attached at two points, over at dead center point position into the end positions (state A, state B). The gear coupling 16 is actuated and the pin-feed tractor wheels 151 are disengaged from the electromotor 11 based on the swivelling of the lever 19 toward the drive shaft 150. In order to secure the pin-feed tractor wheels 151, disengaged from the electromotor 11, against unintended rotary motions, the lever 19 exhibits a locking nose 191. The locking nose 191 engages a crown gear 160 of the gear coupling 16, disposed on the drive shaft 150.

Figure 2:
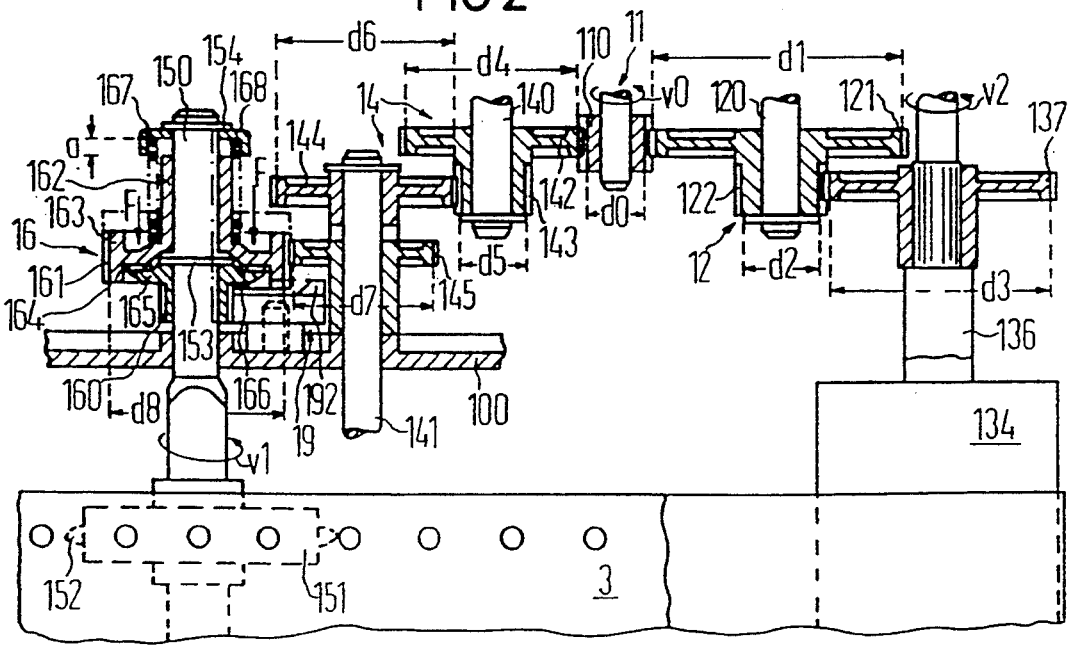
FIG. 2 is a top plan view onto the transport device according to FIG. 1, with a sectional view through a drive chain of the transport device along a section line II . . . II.

FIG. 2 illustrates a top plan view of the transport device 10 with a simultaneous sectional view of the drive chain of the transport device 10 along a section line II . . . II. Accordingly, the first gear wheel drive 12 is formed as a composed spur wheel gearing with two spur wheels 121, 122, rotatably supported on a shaft 120. The spur wheel 121 is thereby engaging the drive pinion 110 of the electromotor 11, while the spur wheel 122 is engaging a gear wheel 137, disposed on a drive shaft 136 of the friction drive 13. The translation ratio of the drive pinion 110 relative to the gear wheel 137 is calculated from the quotient of the diameters d1, d3 of the spur wheel 121 or, respectively, of the gear wheel 137 relative to the diameters d0, d2 of the drive pinion 110 or, respectively, of the spur wheel 122. The second gear wheel drive 14 is formed as a double composed spur wheel drive with four spur wheels 142, 143, 144, 145, rotatably supported on two shafts 140, 141. While the spur wheel 142 is engaged with the drive pinion 110 of the electromotor 11 and while the spur wheel 145 is engaged with a gear wheel 161 of the gear coupling 16, the mutual coupling of the composed spur wheel gearings is provided through the spur wheels 143, 144. The translation ratio of the drive pinion 110 to the gear wheel 161 is calculated from the quotient of diameters d4, d6, d8 of the spur wheels 142, 144 or, respectively, of the gear wheel 161 to diameters d0, d5, d7 of the drive pinion 110 or, respectively, of the spur wheels 143, 145.

The gear wheel 161 comprises (compare for this purpose also FIG. 5, 6) a bushing 162, which continues at one end into an outwardly two-fold angled gear wheel web 163. A first coupling gearing 164 is concentrically disposed on the front face of this gear wheel web 163 disposed remote relative to the bushing. The first coupling gearing 164 is thereby engaging a second coupling gearing 166, disposed concentrically on a gear disk 165 during the continuous form paper operation of the ink jet printing device 1. The gear disk 165 thereby forms together with the crown gear 160 a form element having T-shaped cross-section. The forth element is attached on the drive shaft 150 between a separating wall 100 of the transport device 10 and a first snap ring 153, disposed on the drive shaft 150 . The gear wheel 161 is supported rotatably on the drive shaft 150 in contrast to the gear disk 165 and the crown gear 160.

In addition, the gear wheel 161 can be shifted on the drive shaft 150 by a value a in axial direction against a spring force F of a cylindrical helical spring 167 between the snap ring 153 and a centering disk 168 for the cylindrical helical spring 167. The centering disk 168 is in this context limited in its axial shiftability by a second snap ring 154, disposed on the drive shaft 150. The cylindrical helical spring 167 is disposed on the bushing 162 and pushes with the ends against the gear wheel web 163 and the centering disk 168.

If the lever 19, swivelably supported in the separating wall 100, is now tilted toward the drive shaft 150 for the individual sheet operation of the ink jet printing device 1, then a wedge-shaped projection 192 of the lever 19 presses against the gear wheel 161 and pushes this gear wheel to the side against the spring force F of the cylindrical helical spring 167 in an axial direction of the drive shaft 150. The coupling gearings 164, 166 are thereby brought into disengagement and thus the pin-feed tractor wheel 151 is disengaged from the electromotor 11. The path distance, by which the gear wheel 161 is shifted in axial direction of the drive shaft 150, is determined according to the steps or gradation of the wedge-shaped projection 192 of the lever 19. Since the gear wheel 161 is coupled also in individual sheet operation of the ink jet printing device 1 to the drive pinion 110 of the electromotor 11 through the gear wheel drive 14, the pin-feed tractor wheels 151 can be driven, despite the disengagement from the electromotor 11, by undesired rotary motions generated based on frictional engagements. The gradation is therefore dimensioned such that the axial shifting of the gear wheel 161 on the drive shaft 150 is smaller than the value a.

Figure 3:
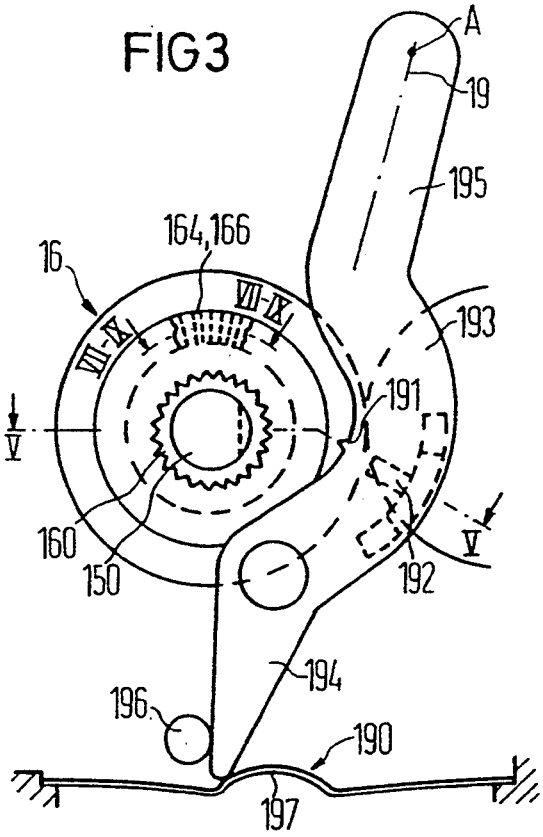
FIG. 3 is a side view of a gear coupling illustrating a first operating position of a lever for the continuous paper operation or, respectively, individual sheet operation of the ink jet print device according to FIG. 1.
Figure 4:
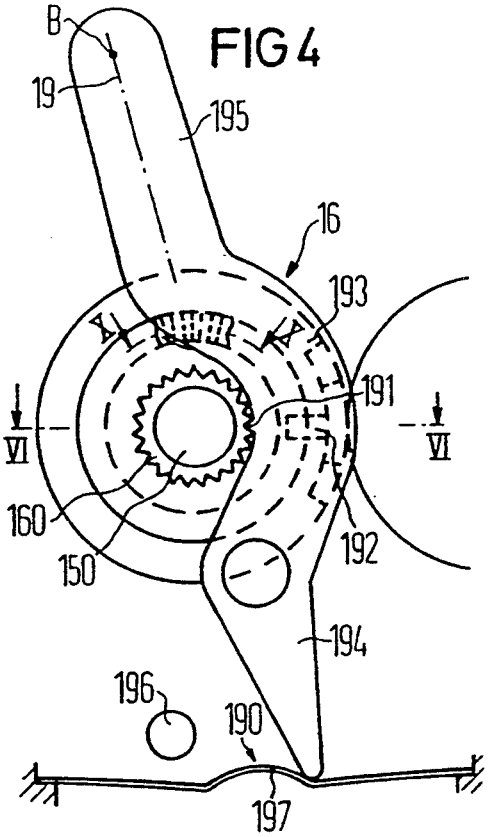
FIG. 4 is a side view of a gear coupling illustrating a second operating position of a lever for the continuous paper operation or, respectively, individual sheet operation of the ink jet print device according to FIG. 1.

FIG. 3 and 4 illustrate a side view of the gear coupling 16 with different operating positions of the lever 19 (state A, state B) for the continuous form paper operation (FIG. 3) or, respectively, individual sheet operation (FIG. 4) of the ink jet printing device 1. The lever 19 exhibits a segment-shaped center part 193, where two lever arms 194, 195 are provided at the ends of the center part 193 and at an obtuse angle relative to the outer diameter of the center part 193. The center part 193 exhibits a curvature in the region of the locking nose, which curvature corresponds to that of the crown gear 160. The wedge-shaped projection 192 is disposed on the back side of the lever 19 and radially staggered relative to the locking nose 191. The lever 19 is tiltably supported at the transition between the center part 193 and a first lever arm 194. The first lever arm 194, ending at an acute angle at the pivot point, rests during the continuous form paper operation of the ink jet printing device 1. The lever 19 is tilted away from the drive shaft 150, with the inner side at a pin 196. Since the rounded tip of the first lever arm 194 rests simultaneously at the foot point of a bulge 197 of the leaf spring 190, the tiltably supported lever 19 is fixed in its position against the spring force of the leaf spring 190.

If the individual sheet operation of the ink jet printing device 1 is now desired by an operating person (FIG. 4), then the lever 19 is transferred by the operating person with a second lever arm 195 from the state A into the state B. The first lever arm 194 is moved against the spring force of the leaf spring 190 over the bulge 197 up to the oppositely disposed foot point during this tilting of the lever 19 toward the drive shaft 150. The locking nose 191 of the lever 19 is engaged into the crown gear 160 during this time such that lever 19 is again fixed in its position against the spring force of the leaf spring 190.

Figure 5:
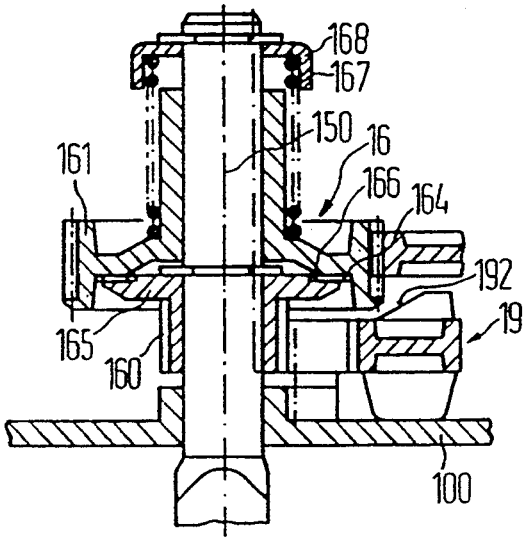
FIG. 5 is a sectional view through the gear coupling according to FIG. 3 along a section line V . . . V.

FIG. 5 illustrates a section through the gear coupling 16 with interacting coupling gearings 164, 166 according to FIG. 3 along a section line V . . . V.

Figure 6:
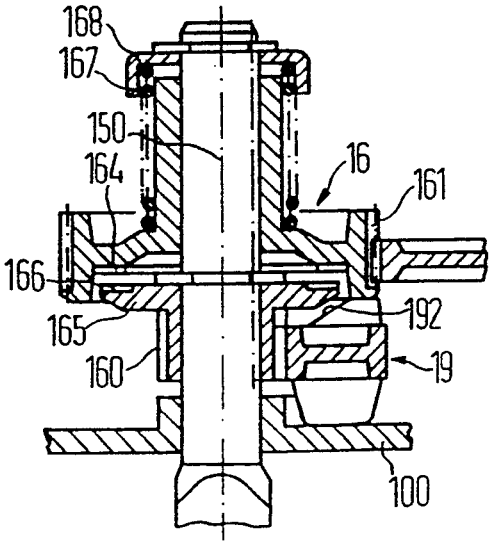
FIG. 6 is a sectional view through the gear coupling according to FIG. 4 along a section line VI . . . VI.

FIG. 6 illustrates a section through the gear coupling 16 with disengaged coupling gearings 164, 166 according to FIG. 4 along a section line VI . . . VI.

Figure 7:
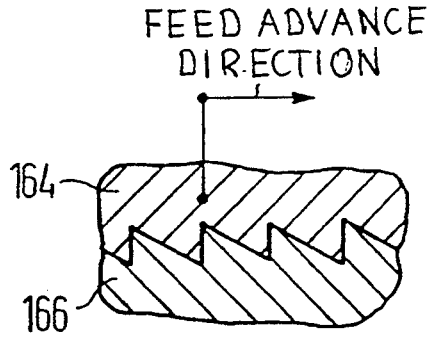
FIG. 7 is a partial sectional view through the gear coupling according to FIG. 3 along a section line VII . . . VII.
Figure 8:
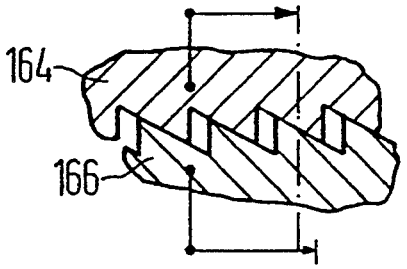
FIG. 8 is a partial sectional view through the gear coupling according to FIG. 3 along a section line VIII . . . VIII.
Figure 9:
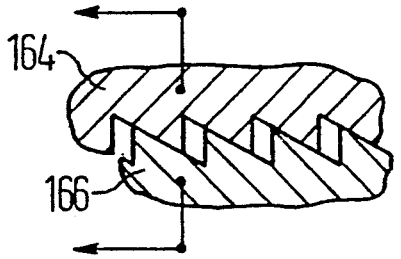
FIG. 9 is a partial sectional view through the gear coupling according to FIG. 3 along a section line IX . . . IX.

FIG. 7 through 9 in each case show a section through the gear coupling 16 according to FIG. 3 along a section line VII–IX . . . VII–IX for different operating phases of the continuous form paper operation of the ink jet printing device 1 according to FIG. 1. The gearing and flank angles and the gear subdivision and tooth pitch of the coupling gearings 164, 166 are tuned such to the spring force F of the cylindrical helical spring 167 that the operating stages illustrated in FIGS. 7 through 9 of the continuous form paper operation of the ink jet printing device 1 can be fulfilled with a good functioning assured.

FIG. 7 illustrates a state of the coupling gearings 164, 166 of the gear coupling 16, wherein the edge-perforated continuous form paper is a form-matchingly advanced from the insertion position IP or, respectively, the stand-by position SP up to the roller wedge 135 of the friction drive 13 by the transport device 15. The further paper advance after the roller wedge 135 is taken up by the printer platen 134 of the friction drive 13. Based on the paper advance difference between the friction drive 13 and the transport device 15 (peripheral speed difference between v1 and v2), there occurs according to FIG. 8 a relative motion between the coupling gearings 164, 166. This relative motion is explained in that the pin-feed tractor wheels 151 and the gear disk 165 with the coupling gearing 166 are pulled along faster by the edge-perforated continuous form paper 3, transported by the friction drive 13, than they are driven by the electromotor 11 and the gear wheel 161 with the coupling gearing 164.

FIG. 9 shows a state of the coupling gearings 164, 166 of the gear coupling 16, wherein the edge-perforated continuous forth paper 3 is transported back force-matchingly and non-positive by the transport device 15, from the tear-off position TP into the print position PP or the stand-by position SP. The friction drive 13 supports the back transport up to the roller wedge 135.

Figure 10:
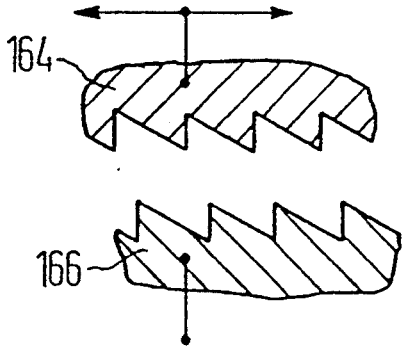
FIG. 10 is a partial sectional view through the gear coupling according to FIG. 4 along a section line X . . . X.

FIG. 10 shows a section through the gear coupling 16 according to FIG. 4 along a section line X . . . X. In this case, the state of the coupling gearings 164, 166 is illustrated, where these coupling gearings 164, 166 are disengaged based on the swiveling of the lever 19 through the wedge-shaped projection 192.

Figure 11:
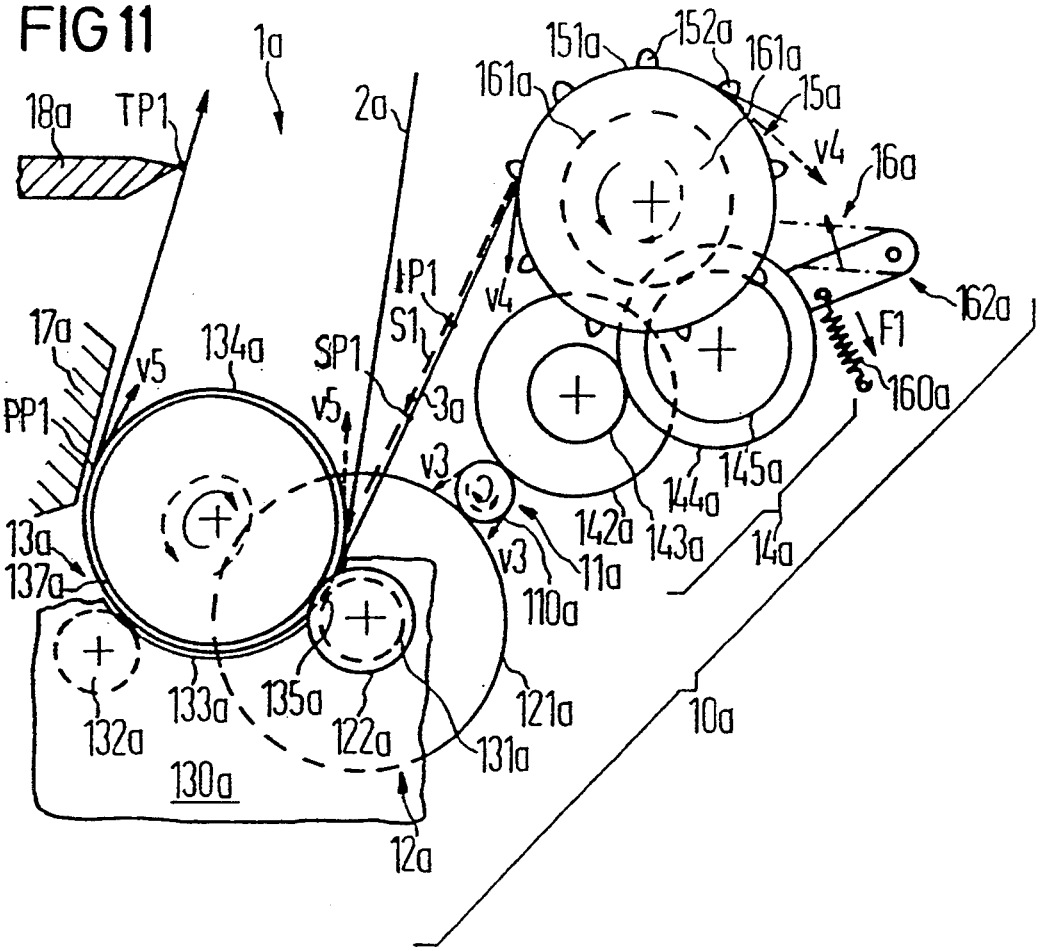
FIG. 11 is a side view of a transport device for ink jet print devices, illustrating a second embodiment of a transport mechanism

FIG. 11 shows the construction of a further transport device 10*a* for the selective transport of individual sheets 2*a* and of edge-perforated continuous form paper 3*a* in an ink jet printing device 1*a* as second exemplified embodiment of the invention. It is a characteristic feature of the transport device 10*a* that an electromotor 11*a* includes a drive pinion 110*a*. The drive pinion is coupled with a first gear wheel drive 12*a* to a second transport device, as seen in advance transport direction of the recording substrate, for example, a friction drive 13*a*, as well as with a second gear wheel drive 14*a* and a claw coupling 16*a* to a first transport device 15*a*, as seen in advance transport direction of the recording substrate, for example, a pin feed platen, for the continuous form paper 3*a*. The first gear wheel drive 12*a* is again formed as a composed spur wheel drive with two rotatably supported spur wheels 121*a*, 122*a*. The second gear wheel drive 14*a* is also formed again as a two-fold composed spur wheel drive with four rotatably disposed spur wheels 142*a*, 143*a*, 144*a*, 145*a*. The friction drive 13*a* includes a paper deflection 130a. Two paper guide rollers 131*a*, 132*a* are disposed in the paper deflection 130*a*. The paper guide rollers 131*a*, 132*a* are disposed such that a rotatably supported printer platen 134*a*, forming with the paper deflection 130*a* a guide channel 133*a*, forms a roller pairing with the paper guide rollers 131*a*, 132*a*. Based on the roller pairing between the printer platen 134*a* and the paper guide roller 131*a*, there is generated a roller wedge 135*a*, into which the individual sheet 2*a* and the continuous form paper 3*a* have to pass in order to be transported by the friction drive 13*a* for the predetermined rotation direction of the drive pinion 110*a* (solid line arrow) into a print position PP1 of a print station 17*a* of the ink jet printing device 1*a*. The mechanical coupling between the friction drive 13*a* and the first gear wheel drive 12*a* is achieved by a gear wheel 137*a*, disposed together with the printer platen 134*a* on a common shaft, wherein the gear wheel 137*a* engages the spur wheel 122*a*.

While the individual sheet 2*a* for the present ink jet printing device 1*a* can be inserted immediately, for example, by hand, into the roller wedge 135*a*, the edge-perforated continuous form paper 3*a* is transported for the illustrated rotation direction of the drive pinion 110*a* (solid line arrow) by the transport device 15*a* into the roller wedge 135*a*. The transport device 15*a* exhibits for this purpose two pin-feed tractor wheels 151*a* with in each case radially protruding pins 152*a*. The pins 152*a* engage an edge perforation to the left and the right of the continuous form paper 3*a*. Alternatively, it is also again possible to provide only one pin-feed tractor wheel 151*a* for the transport device 15*a*. In order to be able to transfer the torque, delivered by the electromotor 11*a*, onto the pin-feed tractor wheels 151*a*, a claw coupling 16*a* is provided, which is coupled to the gear wheel drive 14*a*. It is explained by way of FIG. 12 how the claw coupling 16*a* operates in detail and how it is constructed.

If the edge-perforated continuous form paper 3*a* is placed for the printing up to an insertion position IP1 over the pin-feed tractor wheels 151*a*, then the edge-perforated continuous form paper 3*a* is initially moved for the predetermined rotary direction of the drive pinion 110*a* (solid line arrow) initially with a peripheral speed v4 of the pin-feed tractor wheels 151*a* up to the roller wedge 135*a*. Then, the edge-perforated continuous form paper is picked up by the friction drive 13*a* and is moved along with a peripheral speed v5 of the printer platen 134*a* past the print station 17*a* and a tear-off edge 18*a* of the ink jet printing device 1*a*. In this way, the edge-perforated continuous form paper 3*a* can be brought line by line into a print position PP1, can be printed there line by line, and can be further transported into a tear-off position TP1. The gear ratios of the gear wheel drives 12*a*, 14*a* are thereby selected such that, starting from a peripheral speed v3 of the electromotor 11*a*, the peripheral speed v4 is slightly larger than the peripheral speed v5.

In order to limit the formation of a loop S1 of the edge-perforated continuous form paper 3*a* in connection with these gear transmission ratios, the pin-feed tractor wheel 151*a* is disengaged with the claw coupling 16*a* after each rotation for a short time from the drive pinion 110*a* of the electromotor 11*a*. This is accomplished in that the spur wheel 145*a* after each rotation is automatically lifted in axial direction at a connecting link 162*a*, tiltably supported against a spring force F1 of a spring 160*a*, from the gear engagement with a gear wheel 161*a*. The pin-feed tractor wheel 151*a* is thereby no longer driven by the electromotor 11*a*. By the simultaneous further transport of the edge-perforated continuous form paper 3*a* by the printer platen 134*a*, there occurs a demounting and elimination of the loop S1. When the loop S1 is reduced and the pin-feed tractor wheels 151*a* are pulled along by the friction drive 13*a* over the edge-perforated continuous form paper 3*a*, then the upper dead point of the connecting link 162*a* is also surpassed and the spur wheel 145*a* passes again into engagement with the gear wheel 161*a*. The tiltably supported connecting link 162*a* escapes into the drawn arrow direction. This process of the loop formation and of the loop demounting is cyclically repeated for each rotation of the spur wheel 145*a*.

If according to a first assumption in the continuous paper operation, the print process should be continued at the tear-off position TP1 of the edge-perforated continuous form paper 3*a* after a printing pause, then the edge-perforated continuous form paper 3*a* has to be transported back to the print position PP1. For this purpose, the printer platen 134*a* and the pin-feed tractor wheels 151*a* are driven by the electromotor 11*a* in opposite direction (dashed arrow). The same holds in addition, if the operator of the ink jet printing device la desires that, after printing of the edge-perforated continuous form paper 3*a*, at least one individual sheet 2*a* is to be printed. In this case, the unprinted part of the edge-perforated continuous form paper 3*a*, still disposed in the guide channel 133*a* of the friction drive 13*a*, is to be moved into a so-called stand-by position SP1 for the next print process. The stand-by position SP1 is thereby disposed to such an extent in front of the roller wedge 135a that the individual sheets 2a can be inserted conveniently by hand into the roller wedge 135a. The spur wheel 145a and the gear wheel 161a are engaged with each other during the back transport. The tiltably supported connecting link 162a is thereby pressed away from this spur wheel, for each rotation of the spur wheel 145a, against the spring force F1 in the drawn arrow direction. In order that the edge-perforated continuous form paper 3a still does not tear in the region of the edge perforation based on the speed ratios, predetermined by the translation ratio of the gear wheel drive 12a, 14a, the gear play, occurring during the backwards motion based on hysteresis properties of the gear wheel drives 12a, 14a, is dimensioned such that the edge-perforated continuous form paper 3a can be transported from the tear-off position TP1 to the stand-by position SP1.

If the edge-perforated continuous form paper 3a is disposed in the stand-by position SP1 after the back transport and if the individual sheets 2a are now to be printed, then the rotation direction of the electromotor 11a has to be reversed again (solid line arrow) for this purpose. In addition, it has to be prevented with this rotation reversal that also the pin-feed tractor wheels 151a are again moved forward and thereby the edge-perforated continuous form paper 3a is again moved forward out of the stand-by position SP1. The transport device 15a, 16a exhibits for this purpose a manually operable lever arrangement. A possible embodiment of the lever arrangement is illustrated in FIG. 12.

Figure 12:
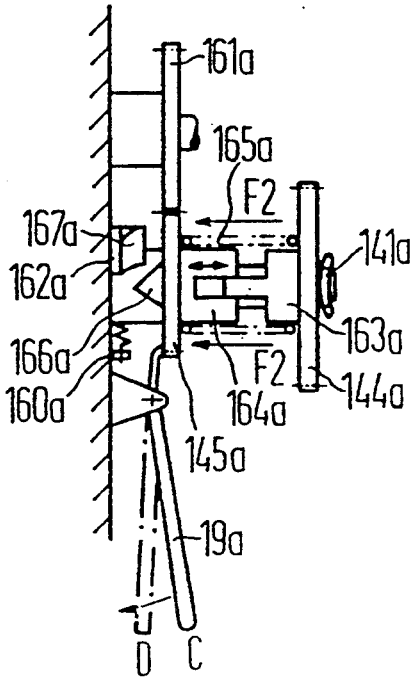
FIG. 12 is a side view of the construction and operating mode of a claw clutch coupling of the transport device according to FIG. 11.

FIG. 12 shows a side view of the claw coupling 16a according to FIG. 11. It is characteristic for the construction and the mode of operation of the claw coupling 16a that the spur wheels 144a, 145a are positively matchingly engaging each other with in each case axially protruding claws 168a, 169a on a shaft 141a. While the spur wheel 144a with the spur wheel bushing 163a is fixedly disposed on the shaft 141a, the spur wheel 145a with the spur wheel bushing 164a can be shifted against a spring force F2 of a cylindrical helical spring 165a on the spur wheel bushing 163a in the drawn arrow direction. In this context, the spur wheel 145a is either engaged with the gear wheel 161a or is disengaged from the gear wheel 161a, as illustrated in FIG. 12. In order to bring the spur wheel 145a into disengagement with the gear wheel 161a, a projection 166a tapering together at an acute angle, is furnished on the side face of the spur wheel 145a disposed remote relative to the spur wheel bushing 164a. For each rotation of the spur wheel 145a in the drawn rotation direction, this projection 166a runs up on an insertion taper 167a of the tiltably disposed connecting link 162a.

The spur wheel 145a is thereby axially shifted against the spring force F2 of the cylindrical helical spring 165a on the shaft 141a and is brought into disengagement with the gear wheel 161a. During this time, where the projection 166a rests on the head point of the insertion taper 167a, the loop S1, generated during the advance transport of the edge-perforated continuous form paper 3a is demounted.

Upon a further rotation of the spur wheel 145a into the drawn rotation direction, the projection 166a moves again away from the head point of the insertion taper 167a. Based on the spring force F2 of the cylindrical helical spring 165a, the spur wheel 145a is thereby again pressed back into its starting position and is brought into engagement with the gear wheel 161a. If the spur wheel 145a is driven opposite to the drawn rotation direction, then the tiltably supported connecting link 162a is pressed away upwardly based on the projection 166a against the spring force F1 of the spring 160a.

FIG. 12 shows in addition how the spur wheel 145a can be brought into disengagement with the gear wheel 161a by a lever arrangement 19a upon a change from the continuous form paper operation of the ink jet printing device 1a to the individual sheet operation. The lever arrangement 19a is therefore transferred from a state C for the drawn arrow direction into a state D.

Figure 13:
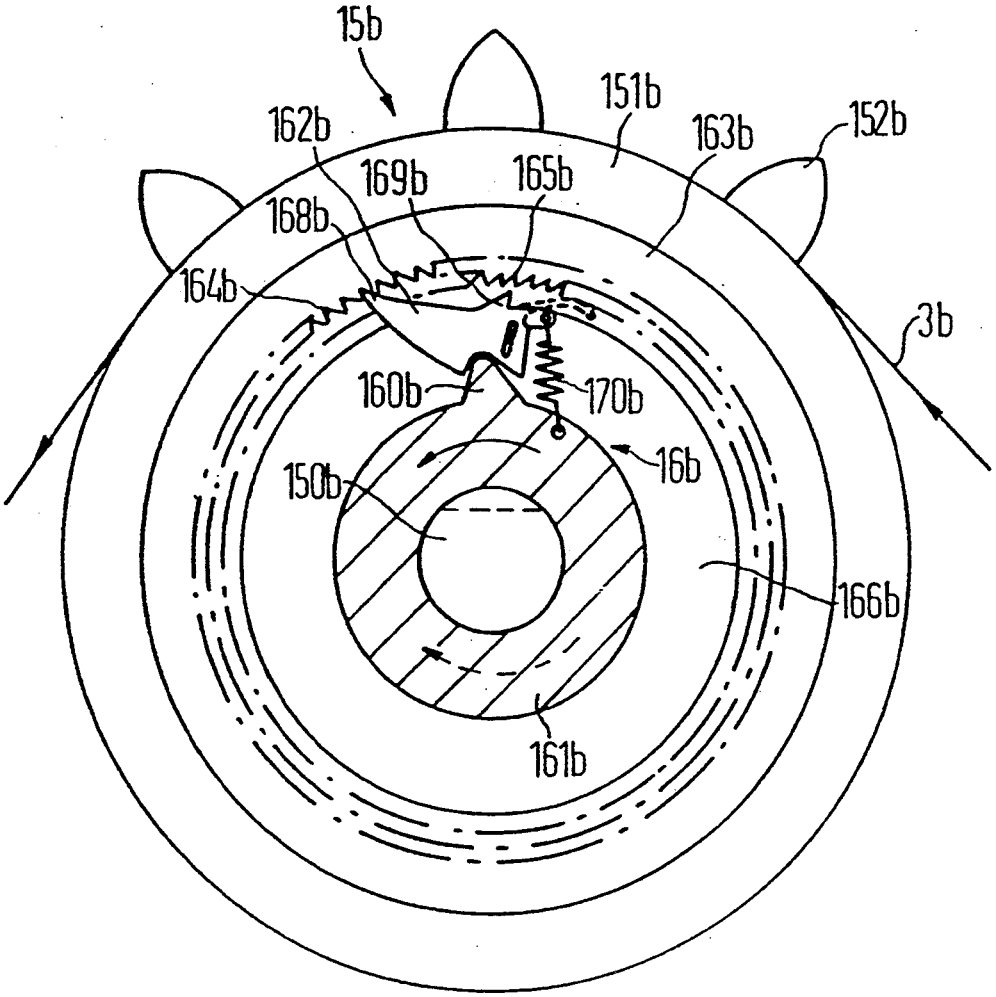
FIG. 13 is a third embodiment of a transport mechanism illustrating a side view of a ratchet mechanism for the transport device according to FIG. 1.

As a third exemplified embodiment of the invention, FIG. 13 shows in a side elevational view a transport device 15b and a ratchet mechanism 16b, such as they can be employed, for example, in the ink jet printing device 1 according to FIG. 1. The transport device 15b as well as the ratchet mechanism 16b are disposed on a drive shaft 150b. The transport device 15b comprises thereby a pin-feed tractor wheel 151b with radially projecting pins 152b. The radially projecting pins 152b engage into an edge perforation of the continuous form paper 3b. The ratchet mechanism 16b comprises a cam wheel 161b driven by an electromotor and rotatably supported on the drive shaft 150b, a rocker 162b swivelably supported on the drive shaft 150b, as well as a wheel 163b with two flange gearings 164b, 165b, disposed radially and axially staggered relative to each other. The wheel 163b is disposed rigidly on the drive shaft 150b. The cam wheel 161b exhibits a radially projecting cam 160b, which is lockingly engaged into a recess 167b of the rocker 162b, tiltably attached at a wheel 166b. The rocker 162b is pressed into the flange gearing 164b or, respectively, 165b of the wheel 163b through the cam 160b depending on the rotation direction of the cam wheel 161b. For this purpose, the rocker 162b exhibits two engagement tips 168b, 169b, which lockingly engage into the respective flange gearing 164b, 165b. In order to connect the rocker 162b in each rocker position positively and form-matchingly to the cam 160b of the cam wheel 161b, there is provided a spring element 170b. This spring element 170b can be furnished according to a first embodiment by a tension spring. The tension spring is thereby attached at the rocker 162b and at the cam wheel 161b. According to a second embodiment, the spring element 170b can also be formed as a springing tab or flap. The springing flap is attached at the rocker 162b and is thereby pressed against the wheel 163b.

If the edge-perforated continuous form paper 3b is transported from the insertion position IP, according to FIG. 1 for the dragon rotation direction (solid drawn arrow), through the cam wheel 161b, driven by an electromotor, into the roller wedge 135, then the cam 160b presses the locking tip 168b of the rocker 162b into the flange gearing 164b of the wheel 163b. The wheel 163b, rigidly supported on the drive shaft 150b, and pin-feed tractor wheel 151b are carried along based on the locking of the locking tip 168b into the flange gearing 164b. Based on the translation ratio of the gear wheel drive 12, 14 relative to the electromotor 11 according to FIG. 1, the pin-feed tractor wheel 151b is carried along faster after the roller wedge 135 by the transport of the edge-perforated continuous form paper 3b than it is driven through the gear wheel drive 14 and the ratchet mechanism 16b. The engagement tip 168b of the rocker 162b is thereby lifted out of the flange gearing 164b and the pin-feed tractor wheel 151b is disengaged from the electromotor 11. Thus, only a frictional torque of the rotatably supported drive shaft 150*b* as well as a further frictional torque, occurring between the wheels 163*b*, 166*b*, has to be overcome by way of paper pulling during the further transport of the edge-perforated continuous form paper 3*b* into the print position PP. The latter is necessary in order to bring the rocker 162*b* into the respective actual operating position. If this frictional torque would not be present, then the rocker 162*b* could freely rotate with the cam wheel 161*b* without coming into engagement with the flange gearing 164*b*, 165*b*.

Upon back transport of the paper, the cam wheel 161*b* is driven into the drawn rotation direction (dashed arrow) by an electromotor. The rocker 162*b* remains standing initially together with the wheels 163*b*, 166*b* and the pin-feed tractor wheel 151*b*. The engagement tip 169*b* of the rocker 162*b* is thereby pressed with the cams 160*b* of the cam wheel 161*b* into the flange gearing 165*b*. The pin-feed tractor wheel 15l*b* is thereby driven in opposite direction and the edge-perforated continuous form paper 3*b* is transported from the tear-off-position TP into the print position PP or into the stand-by position SP.

Again, a lever arrangement according to FIG. 12 can be employed in order to disengage the pin-feed tractor wheel 151*b* from the electromotor 11 during the change from the continuous form paper operation to the individual paper operation. The wheel 166*b* with the rocker 162*b* as well as a gear wheel 161*b* on the drive shaft 150*b* would be axially shifted relative to the fixedly disposed pin-feed tractor wheel 151*b* and wheel 163*b* based on such a lever arrangement.

It will be understood that each of the elements described above, or two or more together, may also find a useful application in other types of devices for transporting recording substrates differing from the types described above.

While the invention has been illustrated and described as embodied in the context of a system for transporting web-shaped recording substrates in printing devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed, as new and desired to be protected by Letters Patent is set forth in the appended claims:

1. A device for transporting web-shaped or individual-sheet-shaped recording substrates in a printing device comprising a gear coupling;

a first transport device including a drive shaft, wherein the first transport device is driven through a gear at a first speed, and wherein the first transport device, acting first in advance transport direction of a recording substrate, is formed by a pin feed drive, driven by the gear coupling;

a second transport device driven through a second gear at a second speed different from the first speed, and wherein the second transport device, acting subsequently to the first transport device in advance transport direction of the recording substrate, is formed by a friction drive, driven without coupling, wherein the individual-sheet-shaped recording substrates are directly fed to the friction drive;

a crown gear formed at the gear coupling and disposed fixed at the drive shaft of the first transport device;

a locking nose engageable with the crown gear;

switching means furnished by an operating lever having the locking nose, provided with a first state and a second state, and disposed in a region of the gear coupling, wherein the operating lever separates the gear coupling in the second state and simultaneously fixes the pin feed drive by means of the locking nose engaging the crown gear;

a gear wheel drive;

a spring element disposed at the drive shaft;

wherein the gear coupling includes a first coupling arrangement, wherein the first coupling arrangement is attached on the drive shaft of the first transport device, wherein the gear coupling includes a second coupling arrangement pushed by the spring element, wherein the second coupling arrangement is supported rotatable and axially shiftable against the spring element at the drive shaft of the first transport device and is thereby coupled to the gear wheel drive based on a pushing force of the spring element, and wherein the second coupling arrangement includes a first coupling element, and wherein the first coupling arrangement includes a second coupling element, wherein the first coupling arrangement is connected to the second coupling arrangement through a first coupling element and through a second coupling element.

2. The device according to claim 1, wherein the friction drive drives the web-shaped recording substrate at a slightly faster speed than the pin feed drive.

3. The device according to claim 1, wherein the friction drive drives the web-shaped recording substrate at a slightly slower speed than the pin feed drive.

4. The device according to claim 1, wherein the first coupling element and the second coupling element are formed as coupling gearings.

5. The device according to claim 1, wherein the switching device disengages the second coupling arrangement from the first coupling arrangement.

6. The device according to claim 5, wherein the switching device is formed as the operating lever having a wedge-shaped projection, and wherein the operating lever is tiltable toward the drive shaft , wherein the wedge-shaped projection presses against the second coupling arrangement upon tilting the operating lever toward the drive shaft, and wherein the wedge-shaped projection shifts the second coupling arrangement in an axial direction against a spring force of the spring element on the drive shaft.

7. The device according to claim 5, wherein the switching device is formed as the operating lever with a wedge-shaped projection and is tiltable toward the drive shaft, wherein the wedge-shaped projection presses against the second coupling arrangement upon tilting the operating lever toward the drive shaft, and wherein the wedge-shaped projection shifts a gear wheel of the second coupling arrangement in an axial direction against a spring force of the spring element on the drive shaft.

8. The device according to claim 7, wherein the locking nose engages the crown gear of the first coupling arrangement disposed fixed at the drive shaft in a state where the operating lever is swivelled toward the drive shaft.

9. The device according to claim 8, further comprising a stop pin;

a leaf spring tensioned between two points and including a bulge, wherein the bulge of the leaf spring fixes the operating lever in the first state against the stop pin and in the second state against the crown gear.

10. A device for transporting web-shaped or individual-sheet-shaped recording substrates in a printing device, wherein a first and a second transport device are in each case driven via a gear at different speeds, and wherein one of the transport devices is in addition driven by a coupling, wherein the first transport device, acting first in advance transport direction of the recording substrate (3, 3*a*, 3*b*), is formed by a pin feed drive (15, 15*a*, 15*b*) driven by a gear coupling (16), and wherein the second transport device, acting subsequently to the first transport device in advance transport direction of the recording substrate (3, 3*a*, 3*b*), is formed by a friction drive (13, 13*a*), driven without coupling, wherein the individual-sheet-shaped recording substrates (2) are directly fed to the friction drive (13, 13*a*), and wherein switching means, furnished by an operating lever (19) and provided with two rest and locking positions (A, B), are disposed in the region of the gear coupling (16), wherein the operating lever (19) separates the gear coupling (16) in a rest position (B.) and simultaneously fixes the pin feed drive (15, 15*a*, 15*b* ) driven by gear coupling (16) by means of a locking nose (191) disposed at the operating lever (9) engaging a crown gear (160) of the gear coupling and wherein a) the gear coupling (16) includes a first coupling arrangement (165, 166), wherein the first coupling arrangement (165, 166) is attached on a drive shaft (150) of the first transport device (15), b) the gear coupling (16) includes a second coupling arrangement (161, 164), wherein the second coupling arrangement (161, 164) is supported rotatable and axially shiftable against a spring force (F) at the drive shaft (150) of the first transport device (15) and is thereby coupled to the gear wheel drive (14), c) the second coupling arrangement (161, 164) includes a first coupling element (164) and the first coupling arrangement (165, 166) includes a second coupling element (166), wherein the coupling arrangements (161, 164, 165, 166) are connected to each other through the first coupling element (164) and through the second coupling element (166).

11. The device according to claim 10, wherein the friction drive (13*a*) drives the web-shaped recording substrate (3, 3*a*, 3*b*) at a slightly faster speed than the pin feed drive (15, 15*b*).

12. The device according to claim 10, wherein the friction drive (13*a*) drives the web-shaped recording substrate (3, 3*a*, 3*b*) at a slightly slower speed than the pin feed drive ( 15*a*).

13. The device according to claim 10, wherein the coupling elements (164, 166) are formed as coupling gearings.

14. The device according to claim 10, wherein the operating lever (19) is a switching device and disengages the second coupling arrangement (161, 164) relative to the first coupling arrangement (165, 166).

15. The device according to claim 14, wherein the switching device is formed as the operating lever (19) with a wedge-shaped projection (192) and is tiltable toward the drive shaft (150), wherein the wedge-shaped projection (192) presses against the second coupling arrangement (161, 164) upon tilting the operating lever (19) toward the drive shaft (150), and shifts the gear wheel (161) in axial direction against the spring force (F) on the drive shaft (150).

16. The device according to claims 14, wherein the switching device forms the operating lever (19) with a wedge-shaped projection (192) and is tiltable toward the drive shaft (150), wherein the wedge-shaped projection (192) presses against the second coupling arrangement (161, 164) upon tilting the operating lever (19) toward the drive shaft (150), and shifts the second coupling arrangement (161, 164) in axial direction against the spring force (F) on the drive shaft (150).

17. The device according to claim 16, wherein the operating lever (19) includes the locking nose (191), and wherein the locking nose (191) engages the crown gear (160) of the first coupling arrangement (165, 166) in a state where the operating lever (19) is swivelled toward the drive shaft (150).

18. The device according to claim 17, further comprising a leaf spring (190) tensioned between two points and including a bulge (197), wherein the bulge (197) fixes the operating lever (19) in a first state (A) furnished as a locking position against a stop pin (196) and in a second state (B) furnished as the rest position against the crown gear (160).

* * * * *